US006553955B1

(12) United States Patent
Hada et al.

(10) Patent No.: US 6,553,955 B1
(45) Date of Patent: Apr. 29, 2003

(54) INTAKE MANIFOLD FOR INTERNAL COMBUSTION ENGINE

(75) Inventors: Masatoshi Hada, Nagoya (JP); Yasuo Sunaga, Koga (JP)

(73) Assignees: Aichi Kikai Kogyo Kabushiki Kaisha, Aichi (JP); Sanoh Kogyo Kabushiki Kaisha, Ibaraki (JP)

( * ) Notice: Subject to any disclaimer, the term of this patent is extended or adjusted under 35 U.S.C. 154(b) by 44 days.

(21) Appl. No.: 09/926,389

(22) PCT Filed: Jun. 14, 2000

(86) PCT No.: PCT/JP00/03888

§ 371 (c)(1),
(2), (4) Date: Oct. 25, 2001

(87) PCT Pub. No.: WO00/77386

PCT Pub. Date: Dec. 21, 2000

(30) Foreign Application Priority Data

Jun. 16, 1999 (JP) ..... 11/169872
Mar. 28, 2000 (JP) ..... 2000/088421

(51) Int. Cl.[7] ..... F01N 7/08

(52) U.S. Cl. ..... 123/184.53; 123/184.61; 123/184.42

(58) Field of Search ..... 123/184.42, 184.53, 123/184.61

(56) References Cited

U.S. PATENT DOCUMENTS 4,960,096 A * 10/1990 Sukimoto et al. ..... 123/568.12
5,038,725 A * 8/1991 Okazaki et al. ..... 123/184.61
5,947,072 A * 9/1999 Loy et al. ..... 123/184.56
6,148,782 A * 11/2000 Fuesser ..... 123/184.53
6,216,656 B1 * 4/2001 Hada et al. ..... 123/184.34
6,286,213 B1 * 9/2001 Hada et al. ..... 29/890.044
6,289,863 B1 * 9/2001 Hada et al. ..... 123/187.47
6,311,678 B1 * 11/2001 Lepoutre ..... 123/568.12

FOREIGN PATENT DOCUMENTS

JP 08338240 A * 12/1996 ..... F01N/7/08
JP 10252456 9/1998
JP 11-22454 1/1999
JP 11139318 5/1999

* cited by examiner

*Primary Examiner*—Willis R. Wolfe
*Assistant Examiner*—Douglas A. Salser
(74) *Attorney, Agent, or Firm*—Dennison, Schultz & Dougherty

(57) ABSTRACT

An air-intake manifold includes a plurality of air-intake pipes connecting between a collector and an air-intake pipe mount. Each air-intake pipe 3 is bent to have a predetermined shape. Each air-intake pipe 3 is fabricated by bending a substantially straight double metal pipe that has an outer pipe 3*a* and an inner pipe 3*b* with a clearance 3*c* therebetween equal to or less than 0.2 mm, such that the outer pipe 3*a* and the inner pipe 3*b* locally contact with each other at an intermediate region. Accordingly, while the outer pipe 3*a* and the inner pipe 3*b* of the air-intake pipe 3 locally contact with each other at the contact point 3*e* (in the relatively slidable relationship), an air layer having a thickness equal to or less than about 0.2 mm is formed between the outer pipe 3*a* and the inner pipe 3*b* at portions except for the contact point 3*e*.

1 Claim, 5 Drawing Sheets

INTAKE MANIFOLD FOR INTERNAL COMBUSTION ENGINE

The present invention relates to an air-intake manifold for an internal combustion engine such as an automobile engine and particularly, to sound insulation at air-intake pipes that form an air-intake manifold.

PRIOR ART

An air-intake manifold for an internal combustion engine includes a plurality of air-intake pipes, which are connected to corresponding cylinders of a multi-cylinder engine and are bundled into groups or a single assembly for preventing the intake air from being interrupted as well as for uniformly distributing the intake air.

FIG. 7 illustrates a typical air-intake manifold for an internal combustion engine to which the present invention is applied. As shown in FIG. 7, an air-intake manifold 1' comprises a collector 2, an air-intake mount 4, and a plurality of air-intake pipes 3'. The collector 2 and the air-intake pipe mount 4 are connected to each other by the air-Intake pipes 3'. Each of the air-intake pipes 3' consists of a metal pipe, such as an aluminum pipe, and is bent to have a predetermined shape. Both ends of each air-intake pipe 3' are fixedly joined to the collector 2 and the air-intake pipe mount 4, respectively.

The conventional air-intake manifold described above involves the following problems. Thus, each air-intake pipe 3' of the air-intake manifold 1' receives noise transmission (that may be caused by pulsation of the intake air or mechanical vibrations in the engine) from the air-intake side of the engine, and the noise in turn propagates or dissipates to the outside of the air-intake pipe 3'. For attenuating such propagated or dissipated sounds, a technique has been used to cover the air-intake pipes 3' with a sound insulating cover that is made of a synthetic resin material or is made of a two-layer steel or aluminum sheet.

However, the sound insulating cover may increase the cost, and in some cases, the appearance of the air-intake pipes 3' covered with the insulating cover is not favorable for the automobile engine. Alternatively, the air-intake pipes 3' may be covered entirely with sound insulating materials. However, the cost will be increased also in this case. In addition, the dissipation of heat will be substantially interrupted.

The present invention has been made in view of the above aspects and is aimed to provide an air-intake manifold for an internal combustion engine, in which propagated or dissipated sounds from the air-intake pipes can effectively be attenuated without covering the air-intake pipes with a separate insulating cover or a sound insulating material.

SUMMARY OF THE INVENTION

According to the invention of claim 1, an air-intake manifold for an internal combustion engine is provided that comprises a collector, an air-intake pipe mount, and a plurality of air-intake pipes connecting between the collector and the air-intake pipe mount, wherein each air-intake pipe is fabricated by bending a substantially straight double metal with smooth pipe surfaces that includes an outer pipe and an inner pipe having different natural frequencies from each having a clearance equal to or less than 0.2 mm therebetween, such that the outer pipe and the inner pipe locally slidably contact with each other at an intermediate region, and the outer pipe and the inner pipe are joined at both ends to each other by brazing.

According to the invention of claim 1, while the outer pipe and the inner pipe of the air-intake pipe locally slidably contact with each other at the intermediate region, an air layer having a thickness equal to or less than about 0.2 mm is formed between the outer pipe and the inner pipe at portions except for the intermediate region.

Therefore, in addition to the sound insulation effect that may be attained by the air layer, the noise attenuation effect can be attained by the relative sliding movement between the outer pipe and the inner pipe at their contact point. Thus, because the outer pipe and the inner pipe have different natural frequencies from each other, the relative sliding movement between them at the contact point may attenuate the vibrations. As a result, propagated or dissipated noises derived from the air-intake pipes can significantly be attenuated in comparison with a conventional single pipe structure that has a wall thickness equal to a sum of the two, outer and inner, pipes.

According to this invention, propagated or dissipated sounds from the air-intake pipes can effectively be attenuated without the use of a separate cover or a sound insulating material. This allows the internal combustion engine to be enhanced in the quietness and to be advantageous in the respect of cost, appearance, and heat dissipation over the conventional one using a separate cover or a sound insulating material to shield the air-intake pipes.

In addition, because the outer pipe and the inner pipe of the air-intake pipe are joined at both ends to each other by brazing, the outer pipe and the inner pipe can share a possible stress that may be generally concentrated on the ends of the air-intake pipe, so that the strength of the air-intake pipe can be considerably improved.

According to the invention of claim 2, in invention of claim 1, the outer pipe and the inner pipe of the air-intake pipe are joined at both ends to each other by brazing.

With the invention of claim 2, the outer pipe and the inner pipe of claim 1 can share a possible stress that may be generally concentrated on the ends of the air-intake pipe, so that the strength of the air-intake pipe can be improved.

DESCRIPTION OF THE PREFERRED EMBODIMENT

Figure 3:
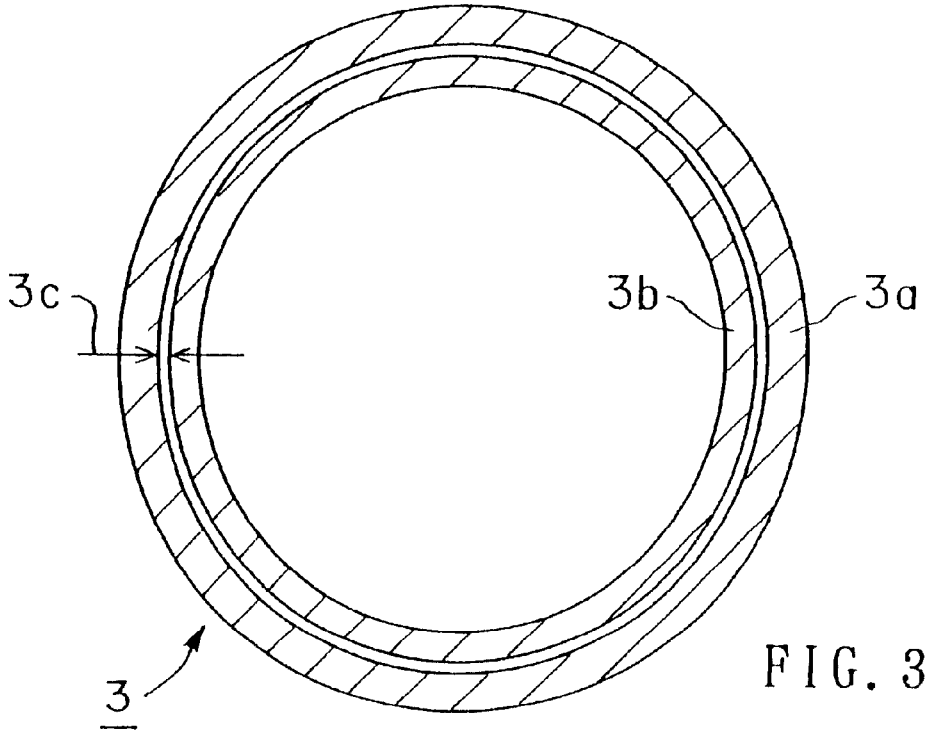
FIG. 3 is a cross sectional view of one end of the air-intake pipe shown in FIG. 1.
Figure 4:
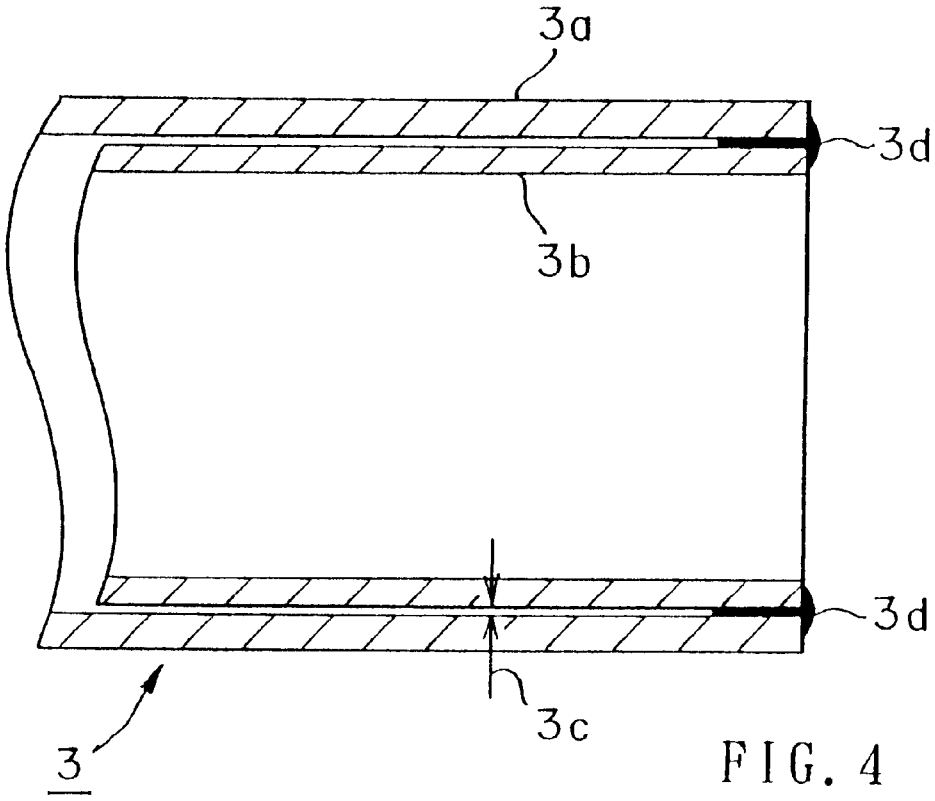
FIG. 4 is a longitudinal sectional view of one end of the air-intake pipe.
Figure 5:
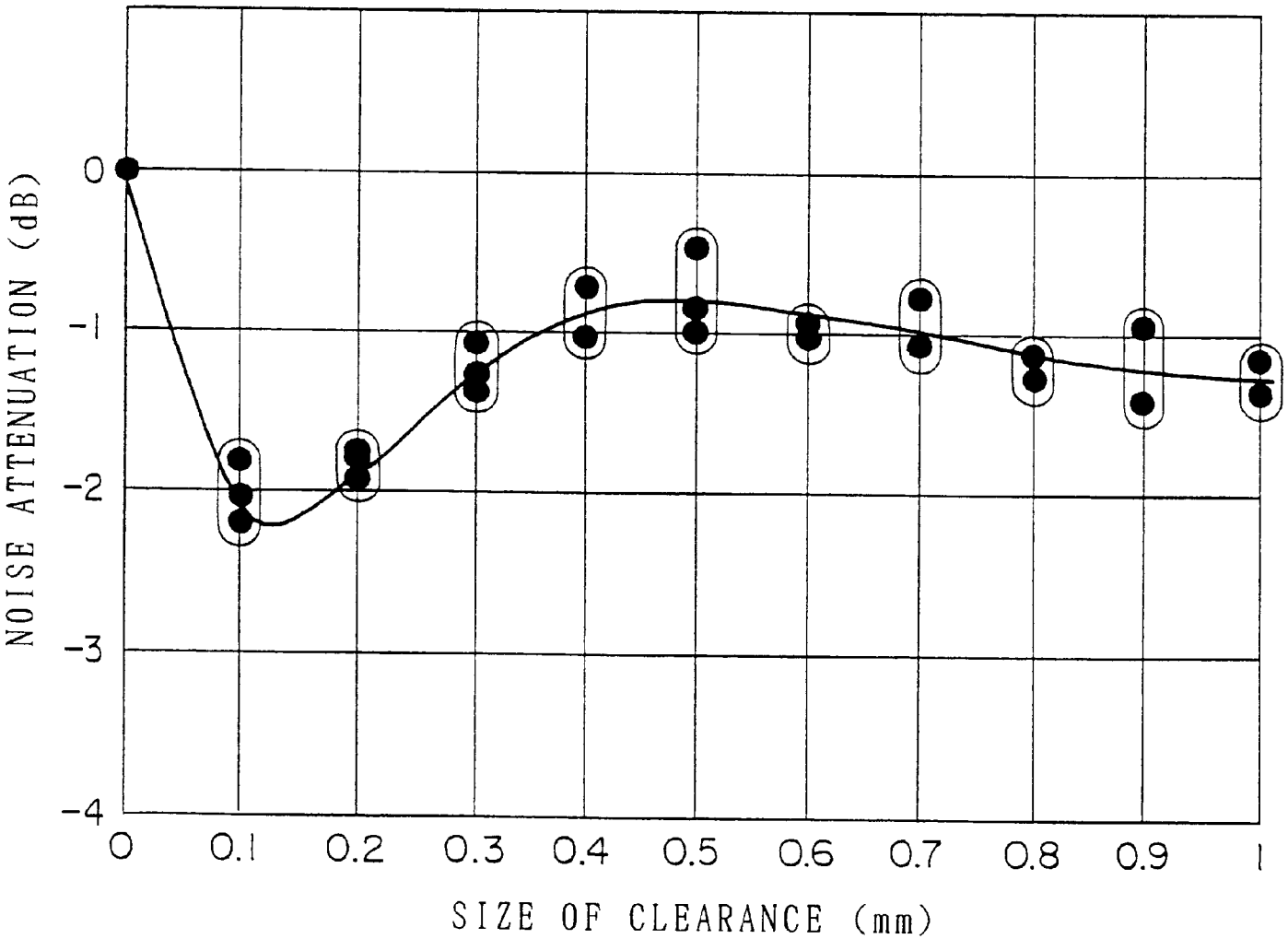
FIG. 5 is a graphic diagram showing an experimental result of the relationship between the noise attenuation and the size of a clearance between an outer pipe and an inner pipe of the embodiment.
Figure 6:
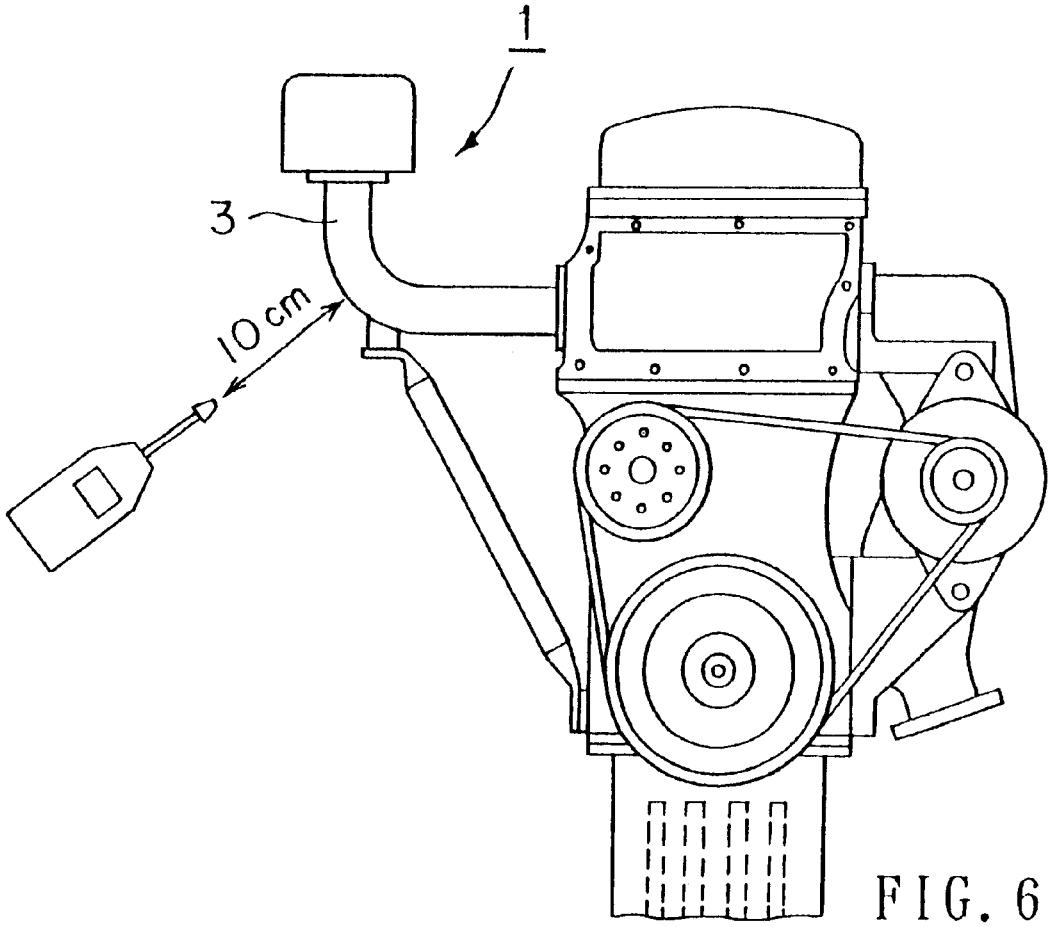
FIG. 6 is a schematic view showing a method of measuring the sound insulation effect that has been used to obtain the experimental result shown in FIG. 5.

One embodiment of the present invention will now be described with reference to the drawings. FIGS. 1, 2, 3 and 4 illustrate the construction of an air-intake manifold for an internal combustion engine according to the embodiment of the present invention. FIGS. 5 and 6 illustrate the result of experiments carried out for proving the effect of the embodiment. In the embodiment shown in FIGS. 1, 2, 3 and 4, like components are denoted like numerals as those of the typical air-intake manifold for an internal combustion engine shown in FIG. 7 and will hence be described in conjunction with FIG. 7.

Figure 7:
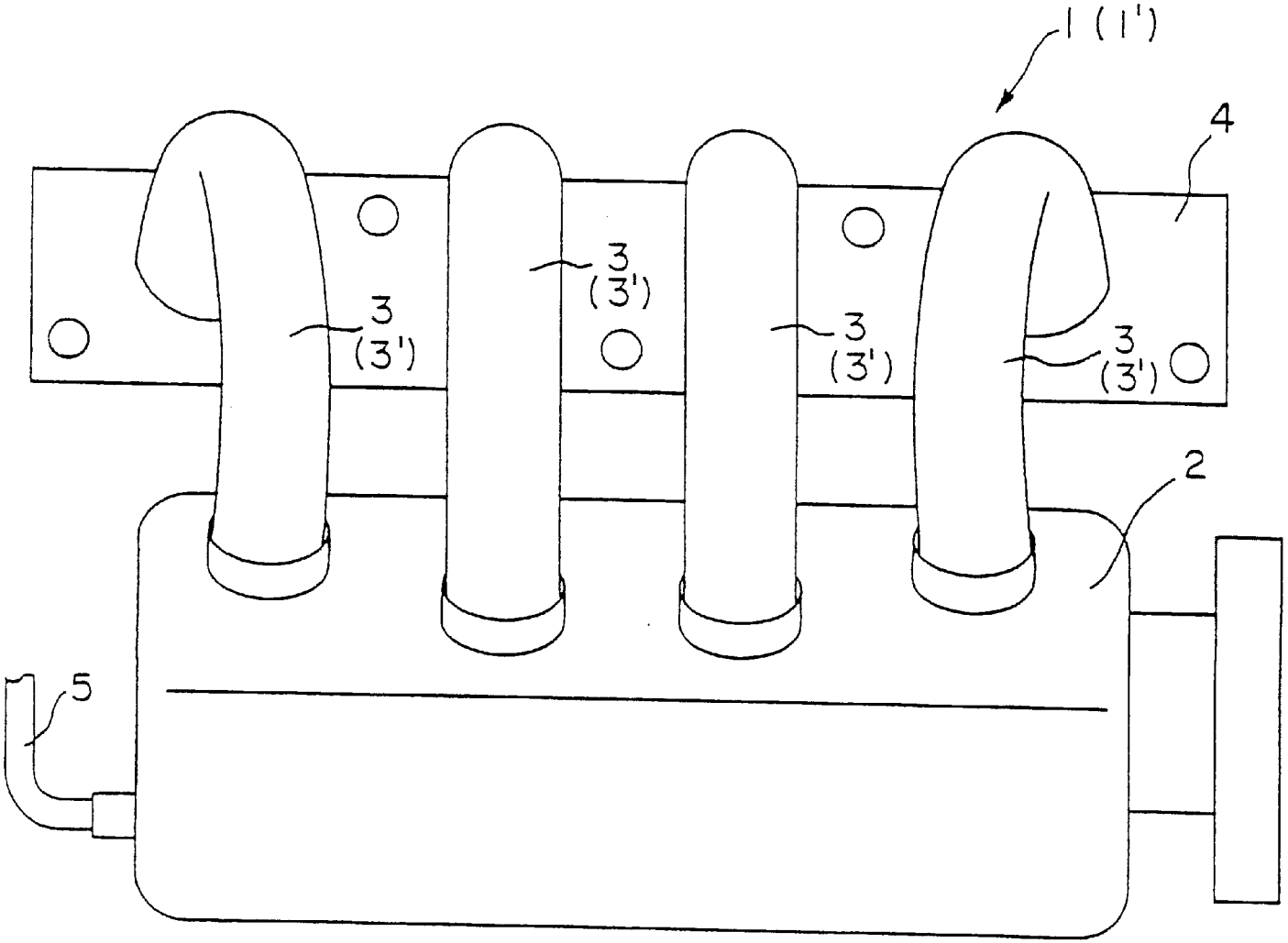
FIG. 7 is a view of a typical air-intake manifold for an internal combustion manifold, to which the present invention is applicable.

As shown in FIG. 7, an air-intake manifold 1 comprises a collector 2, an air-intake pipe mount 4, and a plurality of air-intake pipes 3. The collector 4 and the air-intake pipe mount 4 are connected to each other by the air-intake pipes 3. Each air-intake pipe 3 is bent to have a predetermined shape. Both ends of the air-intake pipe 3 are fixedly joined by brazing or like measures to the collector 2 and the air-intake pipe mount 4, respectively. Denoted by reference numeral 5 in FIG. 7 is a blow-by-gas pipe.

Figure 1:
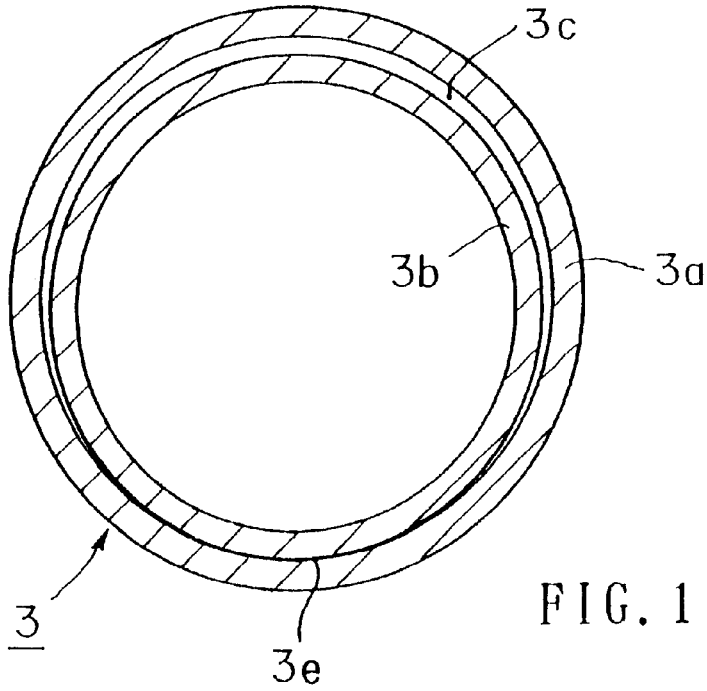
FIG. 1 is a cross sectional view of an intermediate region of an air-intake manifold for an internal combustion engine according to an embodiment of the present invention.
Figure 2:
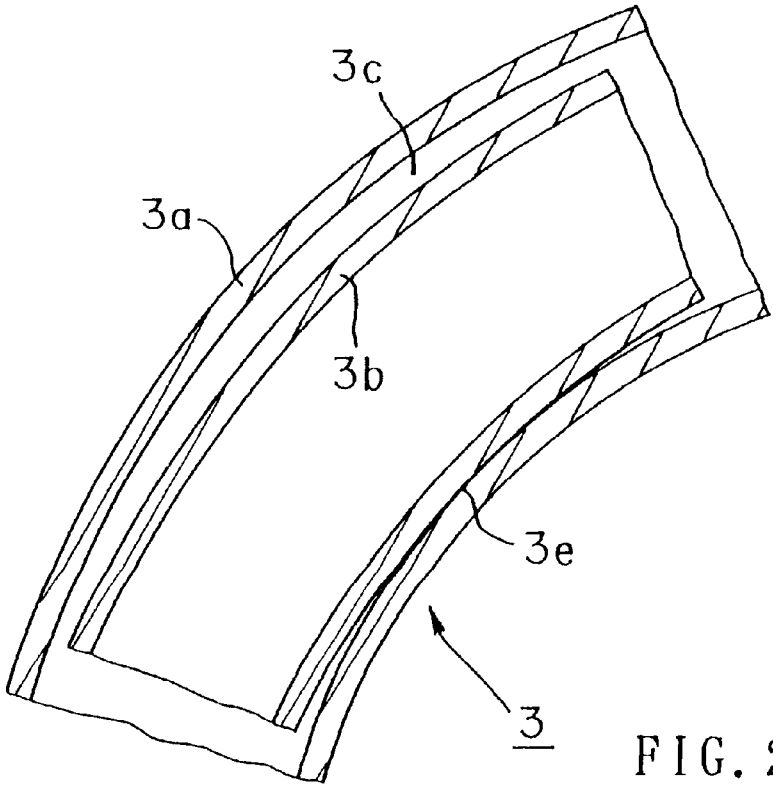
FIG. 2 is a longitudinal sectional view of the intermediate region of the air-intake manifold for the internal combustion engine according to the embodiment of the present invention.

The intermediate region of each air-intake pipe 3 of the air-intake manifold 1 of this embodiment is configured as shown in FIGS. 1 and 2. Both ends of each air-intake pipe 3 are configured as shown in FIGS. 3 and 4. More specifically, the air-intake pipe 3 is fabricated by bending a substantially straight double pipe made of metal (for example, aluminum) that has an outer pipe 3*a* and an inner pipe 3*b* with a clearance 3*c* therebetween, which clearance is determined to be equal to or less than 0.2 mm, such that the outer pipe 3*a* and the inner pipe 3*b* locally contact with each other at the intermediate region of the air-intake pipe 3.

In particular, the outer pipe 3*a* and the inner pipe 3*b* are bent, such that they contact with each other at a contact point 3*e* (FIG. 1) (without being fixed to each other) while they can slide relative to each other by a small distance. Here, as shown in FIG. 4, the outer pipe 3*a* and the inner pipe 3*b* are joined at both ends to each other by brazing at points 3*d*.

The inner diameter of the inner pipe 3*b* is determined depending on the flow rate of air within the inner pipe 3*b*. Both the wall thickness of the outer pipe 3*a* and the wall thickness of the inner pipe 3*b* are determined, such that their natural frequencies are different enough from each other and that necessary mechanical rigidity required for the entirety of the air-intake pipes 3 is ensured. For example, the outer pipe 3*a* may have a wall thickness of 0.8 mm, while the inner diameter and the wall thickness of the inner pipe 3*b* may be 36 mm and 1.2 mm, respectively. In FIGS. 1, 2. 3 and 4, the ratio of the wall thickness to the inner diameter and the ratio of the distance to the inner diameter are exaggerated for the illustrative purpose.

In case that the overall pipe length of the substantially linear double pipe is up to about 500 mm, it may be fabricated by the following process: First, the outer periphery of the outer pipe 3*a* is fixed in position by clamps. Then, the inner pipe 3*b* having an outer diameter slightly smaller than the desired finished size is inserted into the outer pipe 3*a*. A pressure, for example, of 10 to 30 MPa is induced within the inner pipe 3*b* to increase its diameter until the clearance 3*c* is formed.

The operation and effect of the embodiment having the above construction will now be explained.

According to this embodiment, the outer pipe 3*a* and the inner pipe 3*b* of each air-intake pipe 3 locally contact with each other at the intermediate region of the air-intake pipe 3. In addition, an air layer having a thickness equal to or less than about 0.2 mm is formed between the outer pipe 3*a* and the inner pipe 3*b* at portions, except for the contact point. This may provide not only the sound insulation effect due to the presence of the air layer but also the vibration attenuation effect due to the relative sliding movement between the outer pipe 3*a* and the inner pipe 3*b* at the contact point.

More specifically, since the outer pipe 3*a* and the inner pipe 3*b* have different natural frequencies from each other, the relative sliding movement at the contact point 3*e* between the two pipes 3*a* and 3*b* can attenuate vibrations. Here, the vibration attenuation effect due to the relative sliding movement between the outer pipe 3*a* and the inner pipe 3*b* can be adjusted by varying the natural frequencies of either of two pipes 3*a* and 3*b*, for example through suitably determining their wall thickness.

In addition to the difference in natural frequencies, a difference exists in that the outer pipe 3*a* receives transmission mainly of mechanical vibrations from the internal combustion engine, while the inner pipe 3*b* suffers from vibrations due to pulsation of the intake air in addition to the mechanical vibrations. Those events are considered to also improve the vibration attenuation effect obtained by the relative sliding movement at the contact point between the two pipes 3*a* and 3*b*.

Accordingly, the embodiment of the present invention enables to effectively attenuate the propagated and dissipated sounds derived from the air-intake pipes 3 without need of covering the air-intake pipes 3 with a separate cover or a sound insulating material. This may improve quietness of the internal combustion engine, and this embodiment is advantageous in cost, appearance, and heat dissipation efficiency in comparison with the technique to cover the air-intake pipes 3 with a separate cover or a sound insulating material. For example, the increase in cost due to the incorporation of the double pipe structure may be substantially half the increase in cost due to the incorporation of a typical resin cover.

Since the outer pipe 3*a* and the inner pipe 3*b* are joined at both ends to each other by brazing at points 3*d*, they can share a possible stress, which tends to concentrate on the ends of each air-intake pipe 3 (or the fixing portions to the collector 2 and to the air-intake pipe mount 4), hence considerably improving the physical strength.

[Experiment]

FIG. 5 is a graphic diagram showing the experimental result of the relationship between the noise attenuation (dB) and the clearance 3*c* (mm) between the outer pipe 3*a* and the inner pipe 3*b* of the air-intake pipe 3. As shown in FIG. 6, the experiment was conducted with an air-intake manifold 1 for a four-cylinder, 1800 cc automobile gasoline engine, and the experiment has been performed by measuring the sound pressure level (A mode) at a position away from the intermediate region of the air-intake pipe 3 by a distance of 10 cm.

The other experimental conditions are as follows:

Various dimensions of the air-intake pipe: length=400 mm; bent radius 60 mm; inner diameter of the inner pipe=36 mm; wall thickness of the inner pipe=1.2 mm; wall thickness of the outer pipe=0.8 mm.

Operating condition of the engine: 4000 rpm with the throttle valve fully opened.

Instrument for measuring sound pressure: Noise meter with a capacitor microphone (JIS 1st class).

Measured frequency range of sound pressure: 16 to 20000 Hz (a human audible range).

Referring to FIG. 5, the measurements of noise attenuation (dB) (three times at each instance) are plotted in relation to gradual changes in the clearance 3*c* by 0.1 mm, with reference to the reference level (0 dB) in case of the air-intake pipes of a single pipe structure having a wall thickness that is equal to the sum of the wall thickness' of the inner and outer pipes (1.2 mm+0.8 mm=2.0 mm).

According to the results shown in FIG. 5, the noise attenuation is about −2 dB when the clearance 3*c* is equal to or less than 0.2 mm (0.2 mm and 0.1 mm in case of the experiment), as is definitely greater than −1.3 dB when the clearance 3*c* exceeds 0.2 mm. As a result, the experiment has proved the noise attenuation effect of the present invention.

The noise attenuation level is reduced when the clearance 3*c* exceeds 0.2 mm. Such reduction may be caused because the outer pipe 3*a* and the inner pipe 3*b* no longer contact with each other even after they have been bent, resulting in that the noise attenuation effect by the relative sliding movement cannot be attained. When the clearance 3*c* exceeds 0.5 mm, the noise attenuation is slightly bounced back because of the sound insulating effect of the air layer, which is now increased in the thickness.

The sizes of the outer pipe 3*a* and the inner pipe 3*b* of the air-intake pipe 3 are not limited to those described above. For example, if the outer pipe 3*a* and the inner pipe 3*b* are made of aluminum, they may preferably be about 25 to 50 mm and about 20 to 48 mm, respectively, in the outer diameter. The wall thickness of the pipes 3*a* and 3*b* may be 0.5 to 2.5 mm, respectively.

Although the present invention has been described in connection with an air-intake manifold for an internal combustion engine, it may also be applied to any other appropriate conduit such as a blow-by-gas tube, through which compressible fluid flows and in which intrinsic sounds or noises are propagated across a flange or like at one end thereof.

What is claimed is:

1. An air-intake manifold for an internal combustion engine comprising a collector, an air-intake pipe mount and a plurality of air-intake pipes connecting between the collector and the air-intake pipe mount, wherein each air-intake pipe is fabricated by bending a substantially straight double metal pipe with smooth pipe surfaces that includes an outer pipe and an inner pipe having different natural frequencies from each other and having a clearance equal to or less than 0.2 mm therebetween, such that the outer pipe and the inner pipe locally slidably contact with each other at an intermediate region, and wherein the outer pipe and the inner pipe are joined at both ends to each other by brazing.

* * * * *